US011299858B2

(12) United States Patent
Miguelez Tapia et al.

(10) Patent No.: US 11,299,858 B2
(45) Date of Patent: Apr. 12, 2022

(54) METHOD FOR UNLOADING, TRANSPORTING AND INSTALLING A RAILWAY TRACK

(71) Applicants: FCC Construcción, S.A. (FCCCO), Madrid (ES); Contratas y Ventas, S.A.U. (Convensa), Oviedo (ES)

(72) Inventors: Francisco Javier Miguelez Tapia, Madrid (ES); Fernando Fernández Muñiz, Madrid (ES)

(73) Assignees: FCC Construcción, S.A. (FCCCO), Madrid (ES); Contratas y Ventas, S.A.U. (Convensa), Oviedo (ES)

( * ) Notice: Subject to any disclaimer, the term of this patent is extended or adjusted under 35 U.S.C. 154(b) by 647 days.

(21) Appl. No.: 16/310,027

(22) PCT Filed: Jun. 5, 2017

(86) PCT No.: PCT/ES2017/070407
§ 371 (c)(1),
(2) Date: Dec. 14, 2018

(87) PCT Pub. No.: WO2017/216405
PCT Pub. Date: Dec. 21, 2017

(65) Prior Publication Data

US 2019/0330804 A1 Oct. 31, 2019

(30) Foreign Application Priority Data

Jun. 14, 2016 (ES) ..... P201630810

(51) Int. Cl.
*E01B 29/17* (2006.01)
*B66C 23/50* (2006.01)
(Continued)

(52) U.S. Cl.
CPC ..... *E01B 29/17* (2013.01); *B66C 23/50* (2013.01); *E01B 29/02* (2013.01); *E01B 29/20* (2013.01); *E01B 33/00* (2013.01)

(58) Field of Classification Search
CPC ..... E01B 29/00; E01B 29/02; E01B 29/16; E01B 29/17; E01B 29/20; E01B 33/00; B66C 23/50
See application file for complete search history.

(56) References Cited

U.S. PATENT DOCUMENTS 3,465,687 A 9/1969 Kerns
6,981,452 B2 * 1/2006 Herzog ..... E01B 29/17 104/2
(Continued)

FOREIGN PATENT DOCUMENTS

ES 1057004 U 6/2004
ES 2308954 A1 12/2008
(Continued)

*Primary Examiner* — Robert J McCarry, Jr.
(74) *Attorney, Agent, or Firm* — The Webb Law Firm

(57) ABSTRACT

The invention relates to a method for unloading, transporting and installing a railway track, which does not require the rail-carrying train to be brought closer after each cycle of unloading continuous welded rail (CWR), the train remaining parked at the end of the track already laid until all the CWR has been completely unloaded. According to the invention, the method consists of: fastening two rails to a crane of an unloading wagon and moving same through windows along the wagon, facilitating the descent thereof to the track; transferring the rails to a machine for pulling and positioning which moves along, leaving the rails supported on transport elements that move along the track already laid; transferring the rails from the track already laid to a section of sleepers; and moving the rails to their final position, using sliding elements placed on the sleepers.

8 Claims, 24 Drawing Sheets

(51) Int. Cl.

| | |
|---|---|
| ***E01B 29/02*** | (2006.01) |
| ***E01B 29/20*** | (2006.01) |
| ***E01B 33/00*** | (2006.01) |

(56) References Cited

U.S. PATENT DOCUMENTS

| | | | | |
|---|---|---|---|---|
| 8,397,642 | B2 | 3/2013 | Miguelez Tapia | |
| 2005/0172849 | A1 | 8/2005 | Herzog et al. | |
| 2012/0145032 | A1* | 6/2012 | Bounds | E01B 29/17<br>105/4.1 |
| 2014/0219735 | A1* | 8/2014 | Herzog | E01B 31/06<br>408/31 |

FOREIGN PATENT DOCUMENTS

| | | | | | |
|---|---|---|---|---|---|
| ES | 2361309 | A1 | | 6/2011 | |
| ES | 2384150 | A1 | | 7/2012 | |
| KR | 20140094969 | A | * | 7/2014 | E01B 29/16 |
| WO | 9813551 | A1 | | 4/1998 | |
| WO | WO-9813551 | A1 | * | 4/1998 | E01B 29/16 |

* cited by examiner

METHOD FOR UNLOADING, TRANSPORTING AND INSTALLING A RAILWAY TRACK

FIELD OF INVENTION

The invention is related to the technical sector for the maintenance and construction of railway infrastructure. More precisely, it is related to a method for unloading, transporting and installing the rails from a rail-carrying train and it positioning at the place of installation.

BACKGROUND OF THE INVENTION

The procedure historically employed to transport the rails to be laid on a railroad track was to use a provisional track, comprised of wooden sleepers and second use rails. The length of this track for assembling a span of double track is 2,900 meters in spans of 12 meters to optimize its transport.

Recently, several companies have developed systems and procedures that allow the elimination of this auxiliary track.

The rail-carrying train is the means through which the rails usually arrive to the assembly area of the railroad tracks. One of the most analyzed activities within the railroad track assembly process is the unloading of the rails from the rail-carrying train.

There are basically two methods to perform the unloading of the rails, which differ in that, in one of them, the rail-carrying train moves on track that was already laid while the rail remains tied to a fixed point by one of its ends and, in the other method, the rail-carrying train remains stationary while the rail is being removed following the track alignment.

If the first method is employed, a previously assembled track is required, which can be a track to be replaced or an auxiliary track.

With the second method, the rail-carrying train remains stationary on the track, which may be the new track previously laid, and the new rail is removed, which is placed as a continuation of this previously assembled track. This second working method has the advantage of not requiring an auxiliary track or a previously assembled track.

Currently, when it comes to the construction of new railway tracks, the most relevant method is the second one, and it is the one usually used for the purposes of achieving a greater productivity, since it avoids assembling an auxiliary track.

It is unknown in the market the existence of any machine to perform the tasks of unloading and placing railway tracks.

There are some proposals for machines for laying rails, but none of them (with the exception of the specified on the Spanish Patent with Application No. P-200901480 issued to the owner of this patent) perform the functions of dragging, rail hoisting and transporting auxiliary sliding elements.

DISCLOSURE OF THE INVENTION

It is necessary to offer an alternative to the state of the art which closes the gaps found therein.

To this end, the present invention provides a method for transporting and transferring railway track comprising the following steps:

a) tying by the slings two rails located in a rail-carrying train to the crane of a wagon for unloading and laying the railway tracks, b) pulling, said unloading wagon, from said rails, to move them on each of the support elements of said unloading wagon until the most advanced end of the rails reaches the support element furthest away from the rail-carrying train, c) changing the rail ties from the crane of said unloading wagon to a puller machine for unloading and placing railway tracks, d) pulling, said puller machine, from said rails, while said machine travels and moves away from the unloading wagon, where, as said machine moves forward, transport elements move from said unloading wagon on the already laid track, and thus said rails are supported on said transport elements while they move along the track, e) once the assembled track is finished, said rails go through a transfer element located at the end of said assembled track to sliding elements located along the sleepers where the unloaded rails will be placed, and f) recovering the sliding elements on which the rails are supported with the help of a crane of said machine and leave said rails resting on the sleepers in their final position.

Embodiments of the system of the invention are described according to the attached claims, and in a later section.

This invention achieves a performance clearly superior to that of conventional processes, thanks to the substantial increase in the number of cycles per production day and the release of material assets that are essential in all known systems, substantially reducing the cost of installing the railway tracks.

This method does not require pulling the rail-carrying train after each unloading cycle of continuous welded rail (CWR), rather the rail-carrying train is stationary at the end of the previously assembled track and does not need to be moved until the unloading of all CWR on the rail-carrying train is finished. Thus, the locomotives that perform a traction service in these transports between unloading cycles are expendable, because the rail-carrying train is stationary.

This allows them to be used during the time of unloading in other tasks within the assembly process, such as the distribution and application of ballast, or the transport of rail detours, thus optimizing resources and reducing the costs of track installation.

In addition, the versatility of the present invention allows the unloading of rails on sleepers placed on the ballast bed, and particularly on the concrete slab of tunnels, which allows the CWR to be distributed along the tunnel for subsequent plate mounting.

Another type of advantages of this invention are the environmental ones, since it diminishes the environmental impact on air quality, since it reduces the pollution load, through the reduction of exhaust gas emissions. Proportionally, the environmental impact on the consumption of energy resources is also reduced.

It also has advantages regarding ergonomic and occupational hygiene aspects: in the field of Occupational Risk Prevention, this new method ostensibly improves the sanitary conditions of the operators of the assembly process, especially when it comes to carrying out the unloading of rails in the form of CWR for the installation of slab track inside tunnels or other confined spaces. The disappearance of exhaust gas emitted by the traction locomotives of the rail-carrying train translates into a substantial improvement in air quality and a clear reduction in the need for ventilation.

These and other advantages are evident in the light of the detailed description of the invention.

BRIEF DESCRIPTION OF THE DRAWINGS

The foregoing and other advantages and characteristics shall be more completely understood from the following detailed description of the embodiments, with reference to the attached drawings, which are to be considered in an illustrative rather than a limitative manner, in which:

FIG. 6A shows an elevation view of the unloading wagon, where the crane can be seen at one end, while

FIG. 6C shows an enlarged detail with respect to FIG. 6A where the support elements appear next to other elements, while

DETAILED DESCRIPTION OF THE INVENTION

Figure 1:
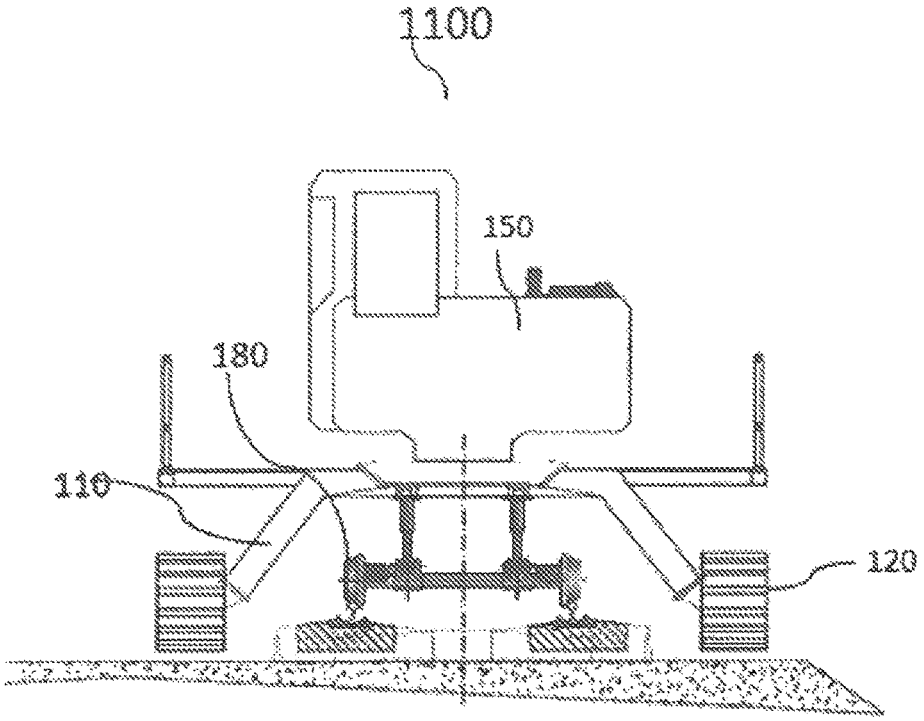
FIG. 1 shows a front view of the puller machine where the railway wheels are seen resting on the rails, while the driving elements of the frame are in the air.
Figure 2:
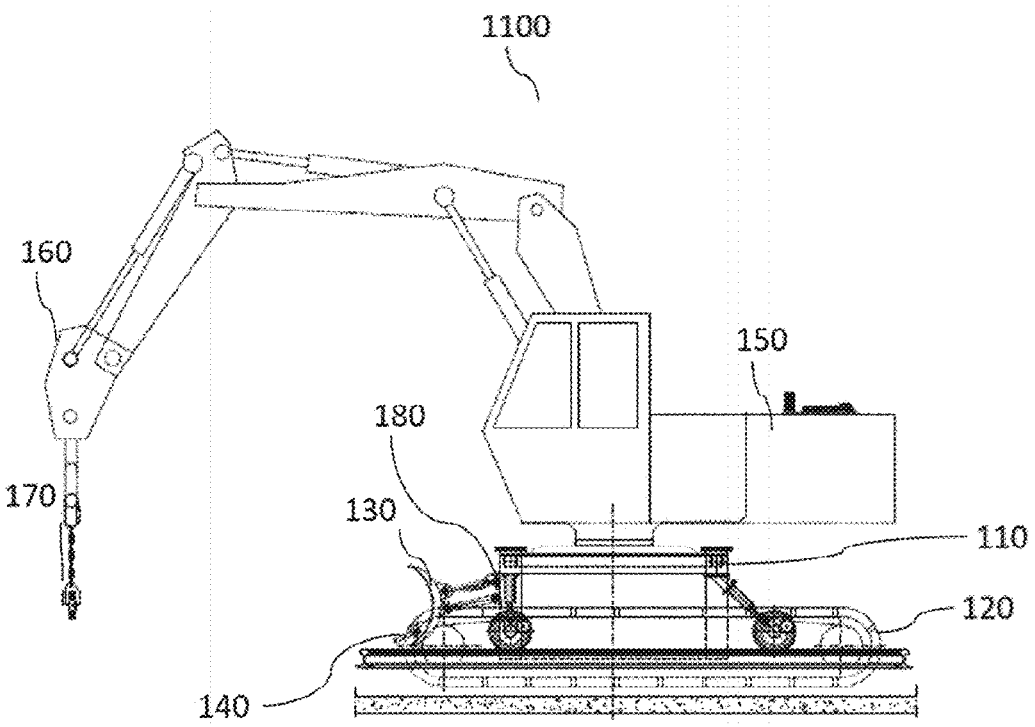
FIG. 2 shows a side view of the puller machine where the railway wheels are seen resting on the rails, while the driving elements of the frame are in the air, and where the transverse beam for tying and pulling and the hinged arm with the clamp for rails is seen.
Figure 2A:
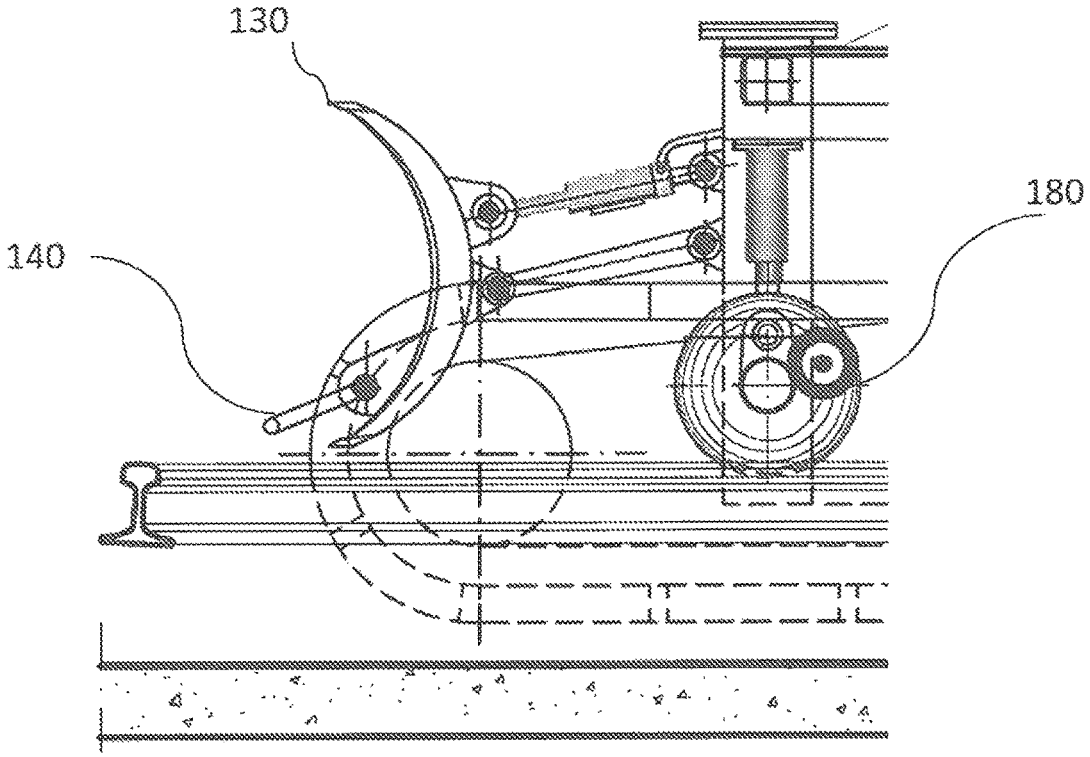
FIG. 2A shows, with reference to the previous Figure, an enlargement of the tying element.
Figure 3:
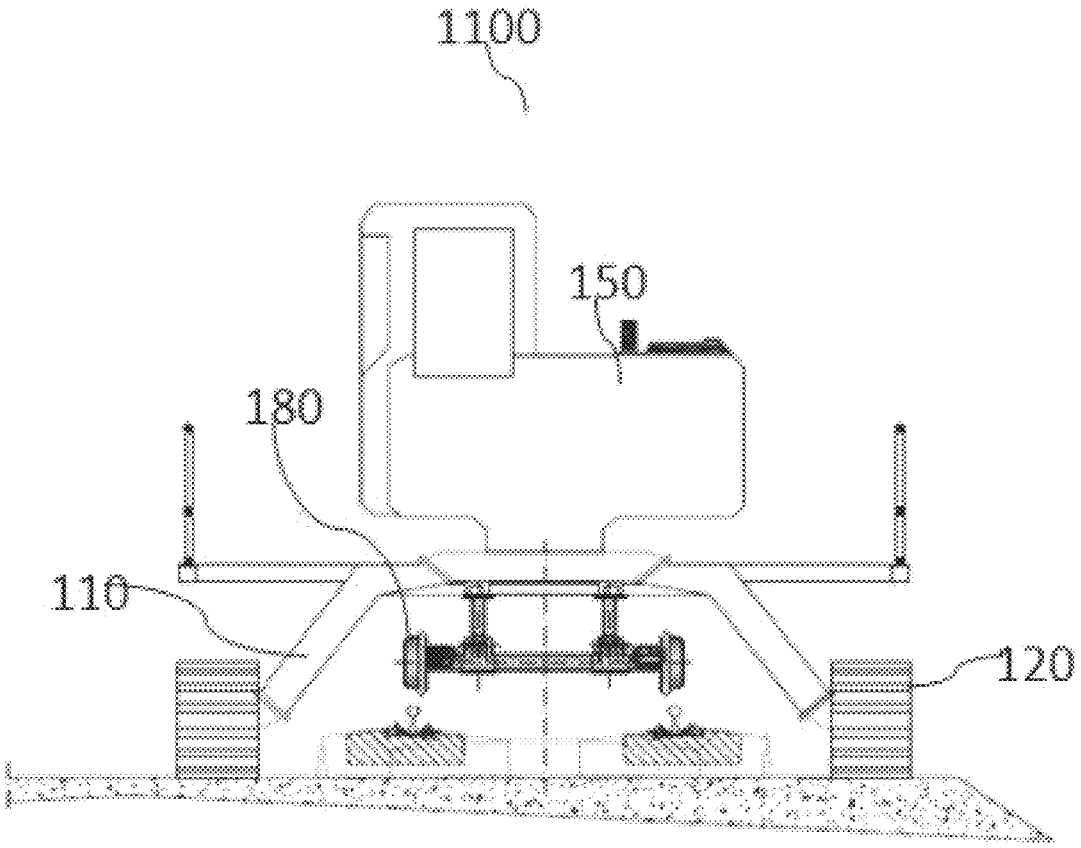
FIG. 3 shows a front view of the puller machine where the railway wheels are seen in the air, not resting on the rails, while the driving elements of the frame are on the ground.
Figure 4:
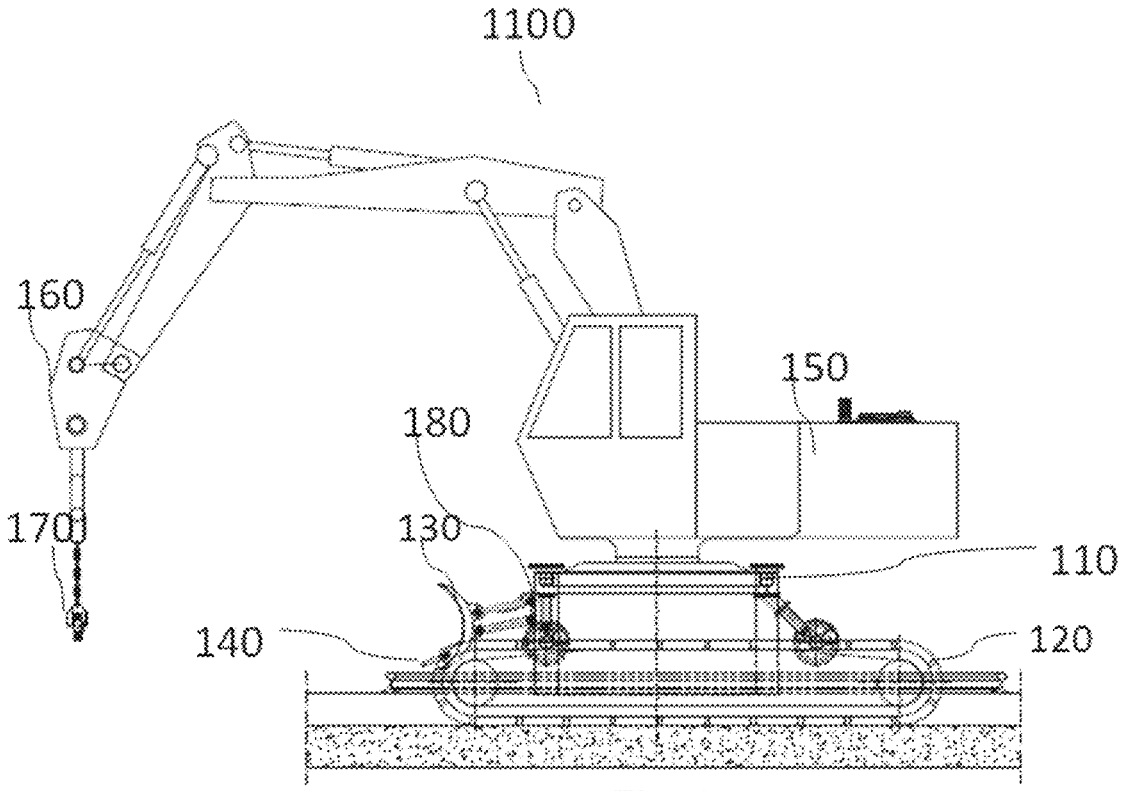
FIG. 4 shows a side view of the puller machine where the railway wheels are seen in the air, not resting on the rails, while the driving elements of the frame remain resting on the ground, and where the transverse beam for tying and pulling and the hinged arm with the clamp for rails is seen.
Figure 5:
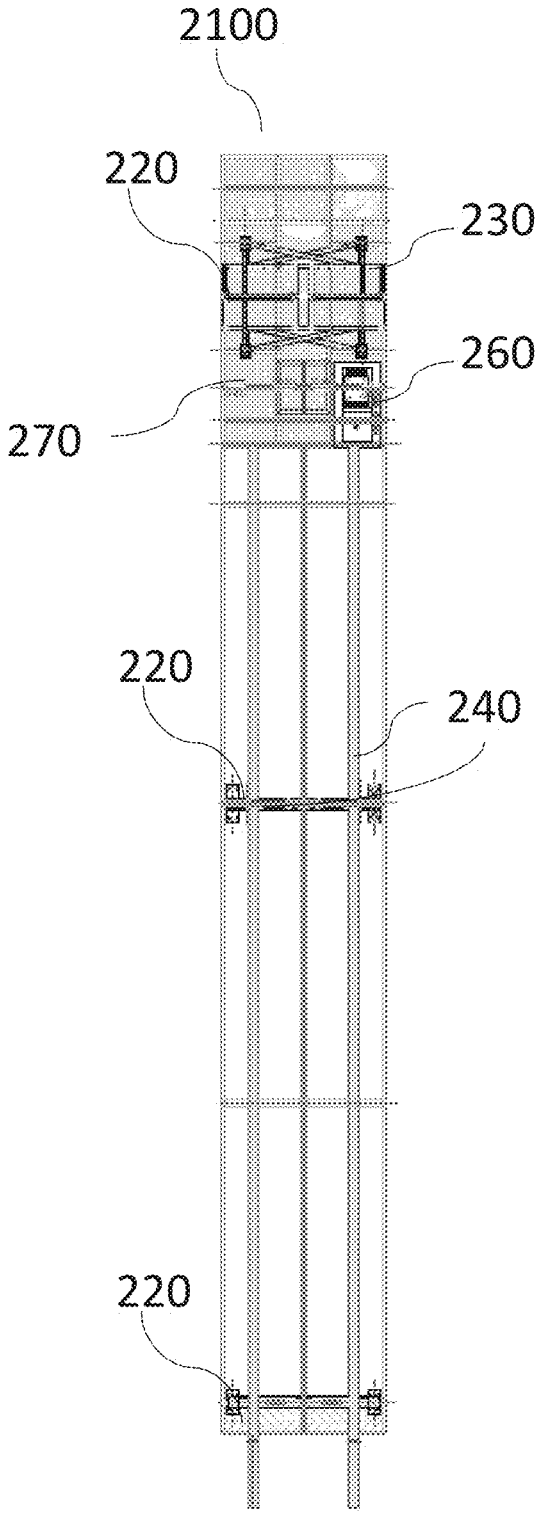
FIG. 5 shows a plan view of the unloading wagon.
Figure 6A:
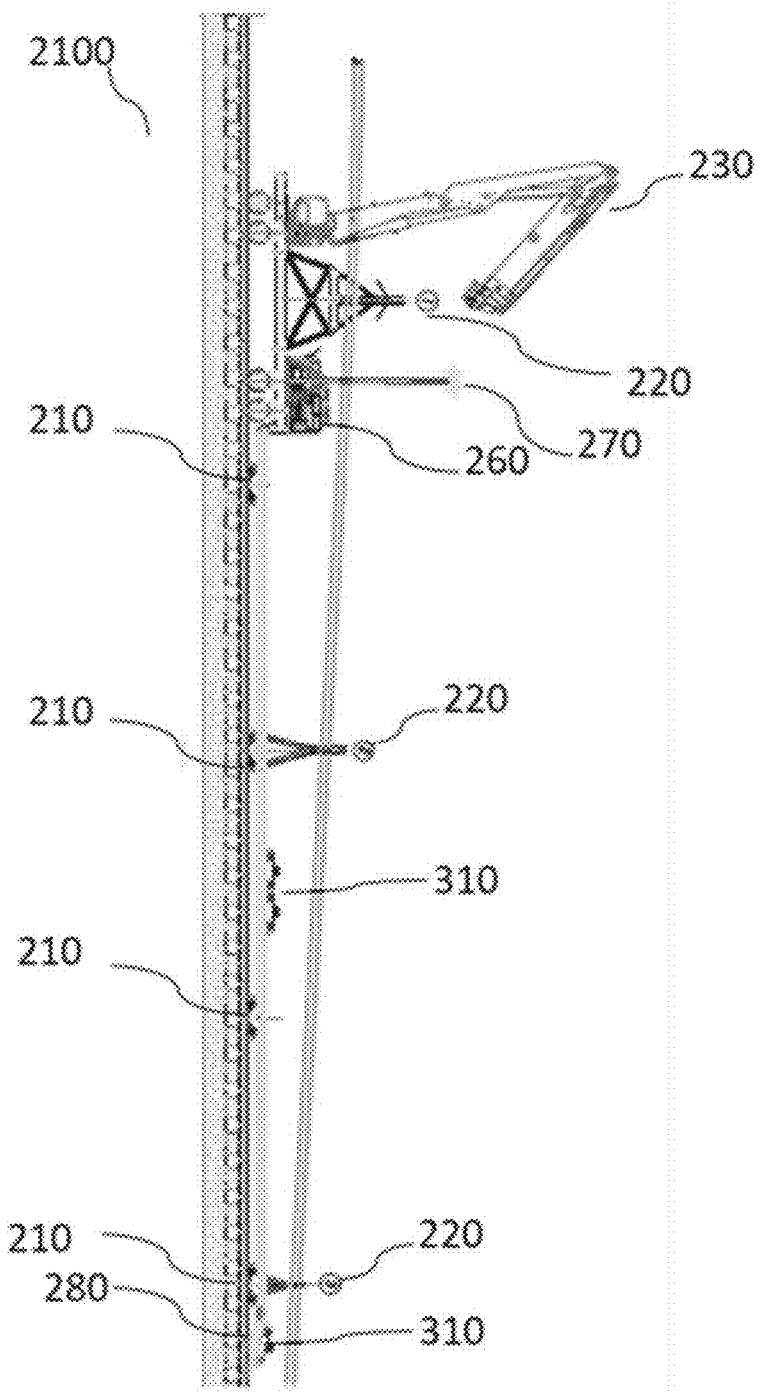
Figure 6B:
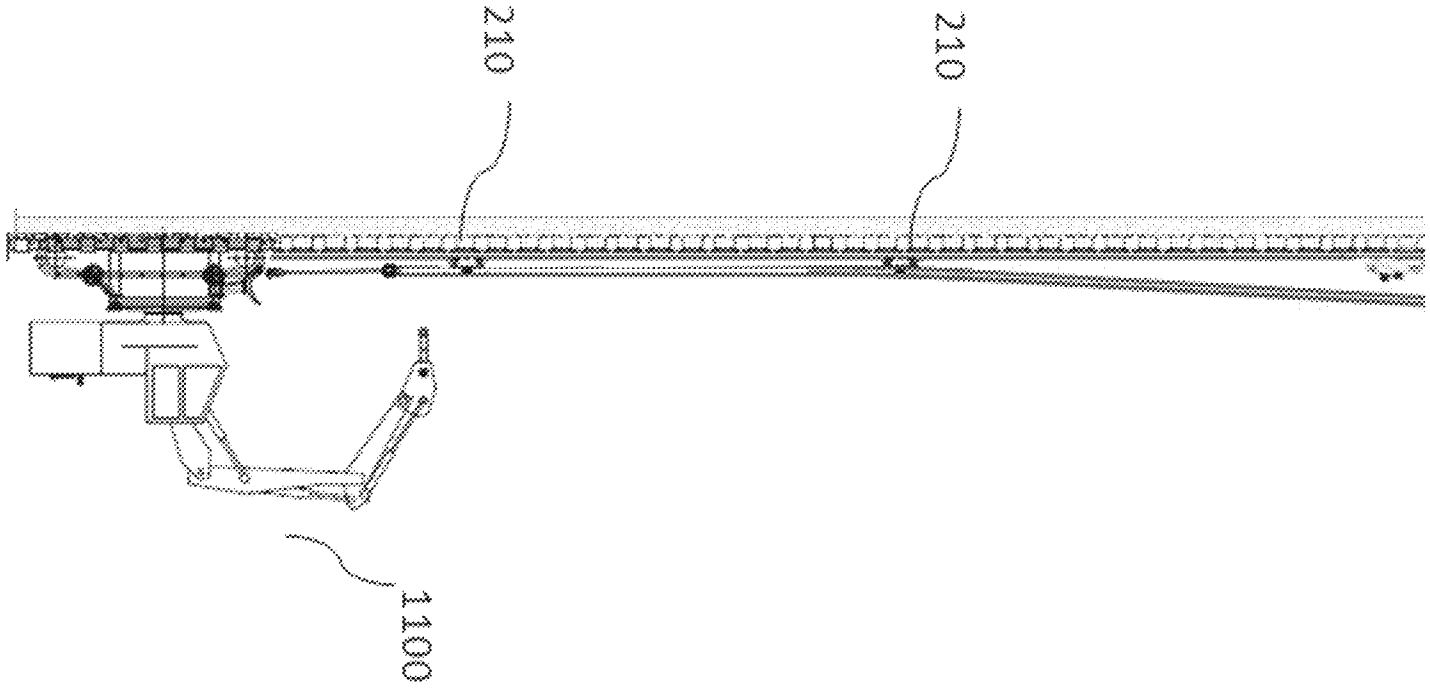
FIG. 6B shows the other end of the unloading with the puller machine supporting said unloading.
Figure 6C:
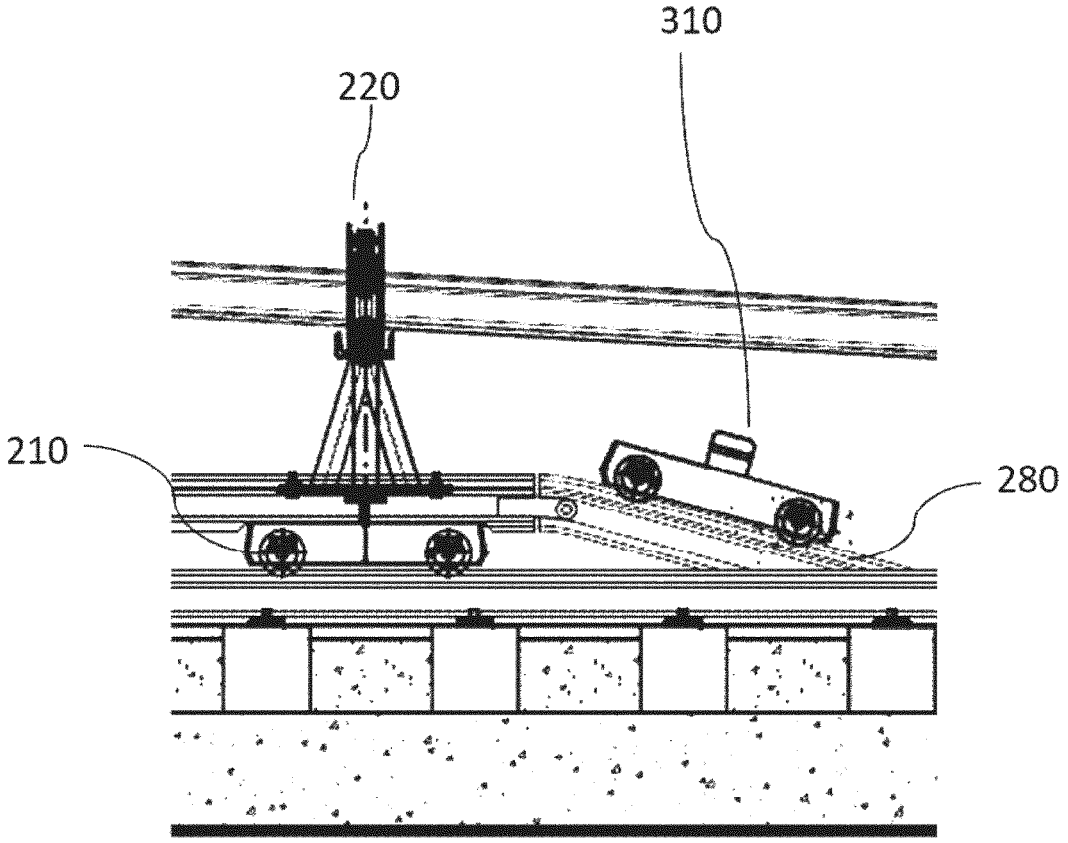
Figure 6D:
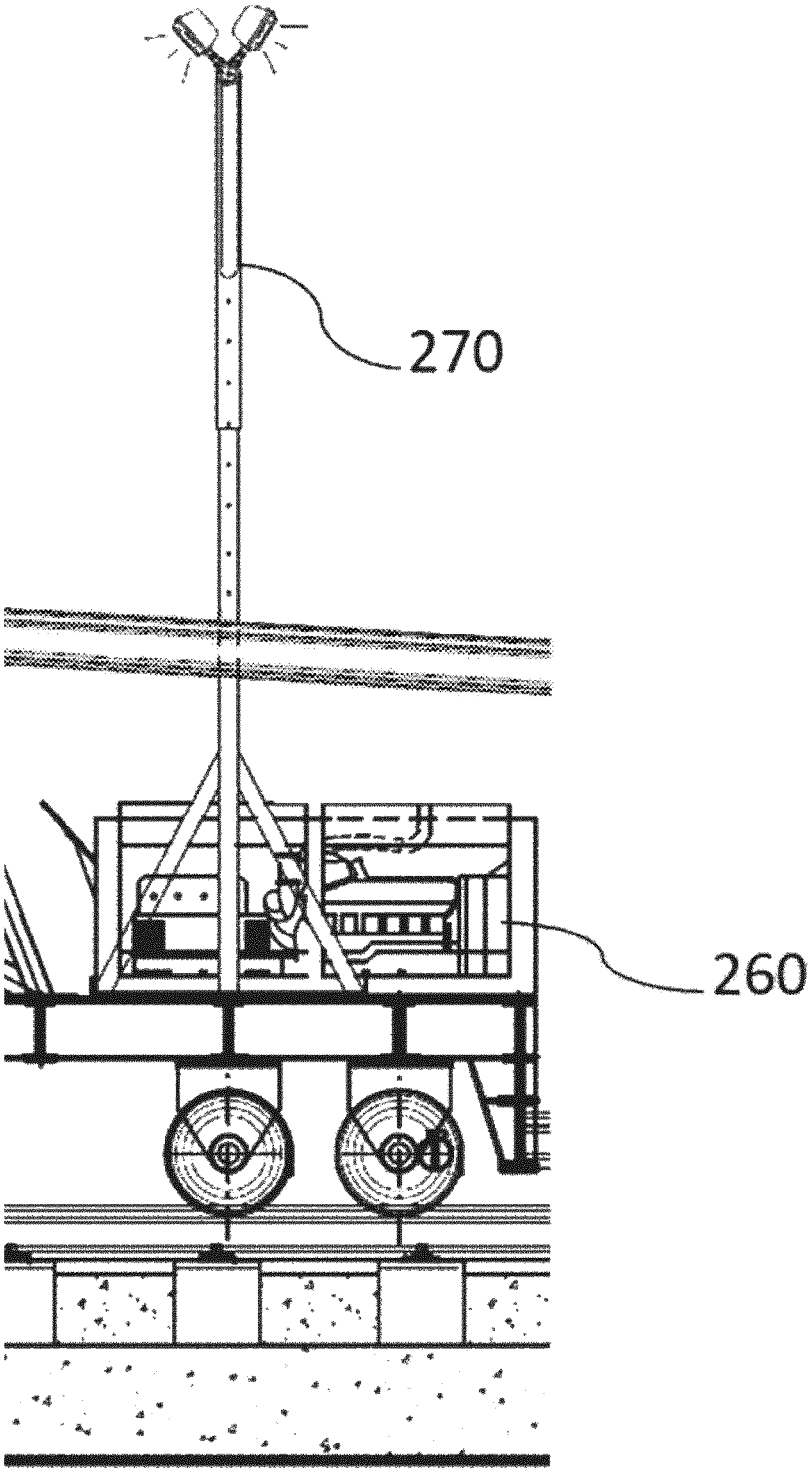
FIG. 6D shows the lighting tower in greater detail, also in relation to FIG. 6A.
Figure 7:
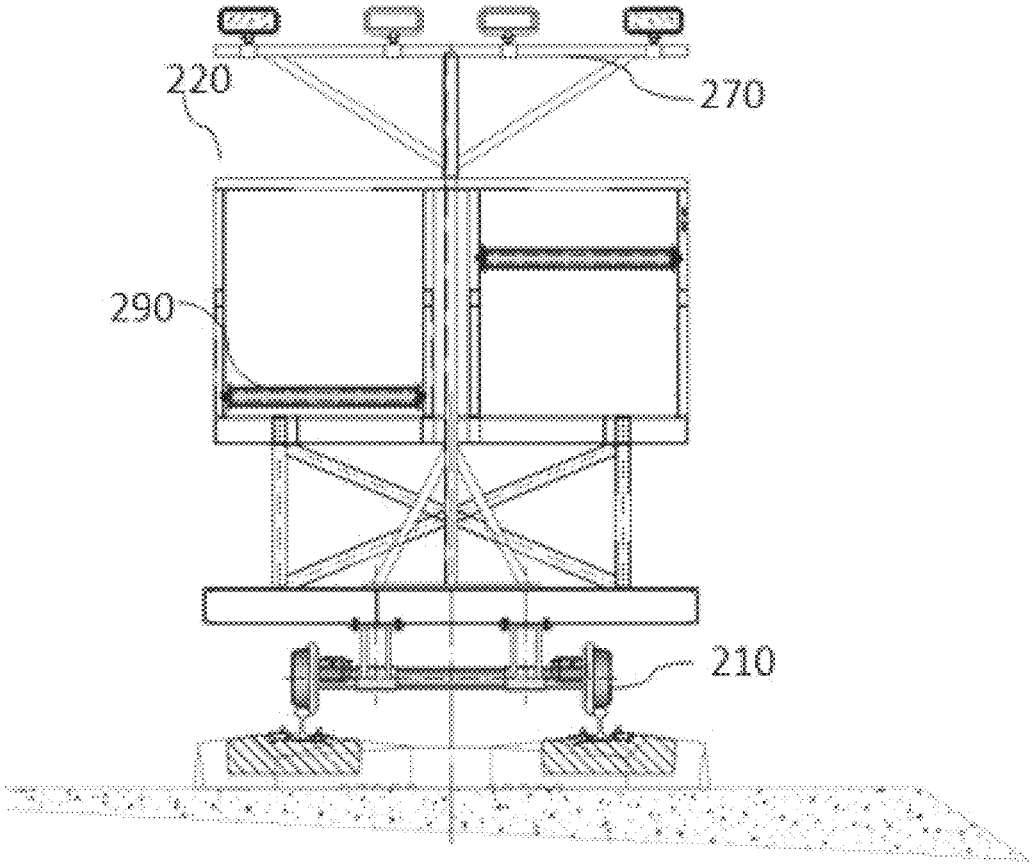
FIG. 7 shows a front view of an example support element of greater height, which could be located at the beginning of the rail unloading point. Likewise, the Figure shows the lighting tower which can be incorporated to the wagon.
Figure 8:
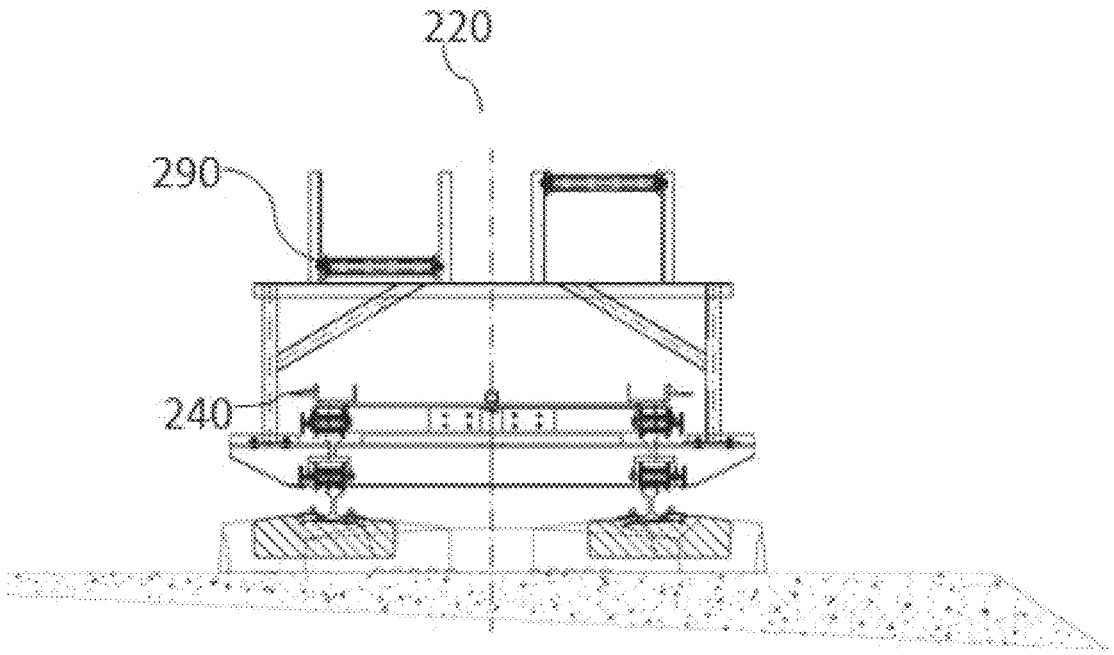
FIG. 8 shows a front view of an example support element of medium height, related to the one above.
Figure 9:
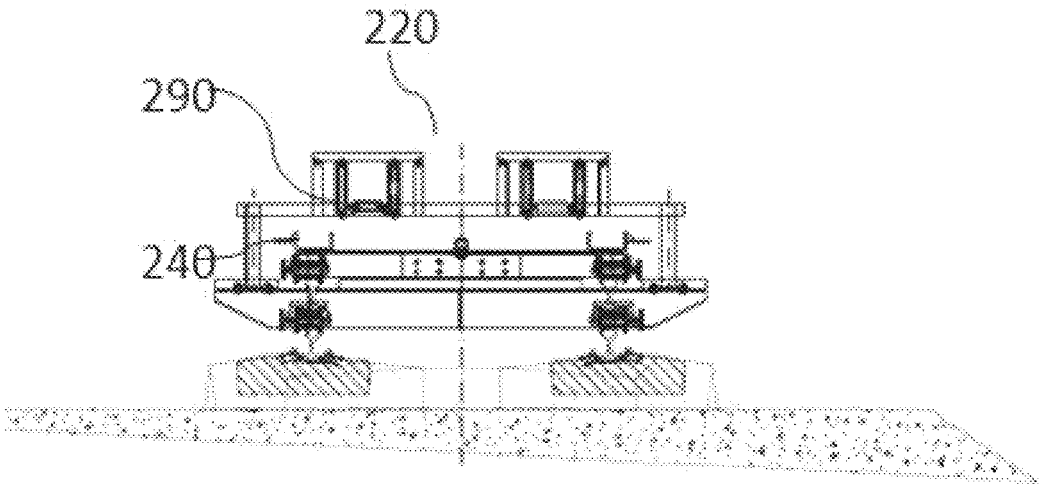
FIG. 9 shows a front view of an example support element of lesser height, which could be located at the end of the unloading point on the wagon.
Figure 10A:
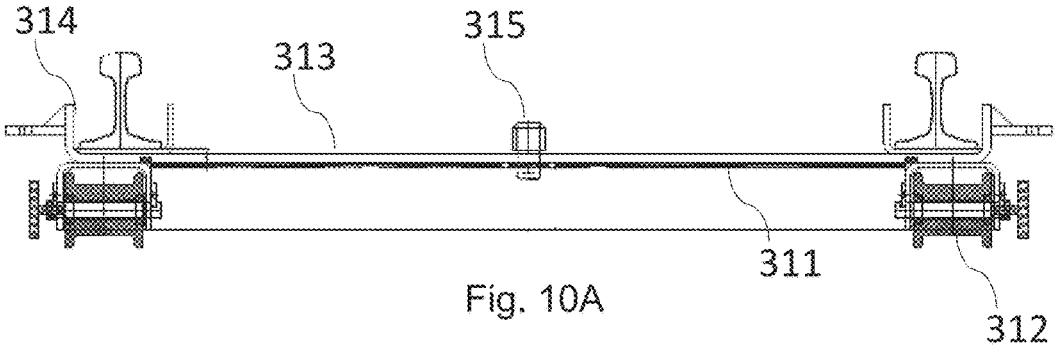
FIG. 10A shows a front view of a transport element of the railway track transport and transfer system. In this example, the element is arranged for a narrow track width.
Figure 10B:
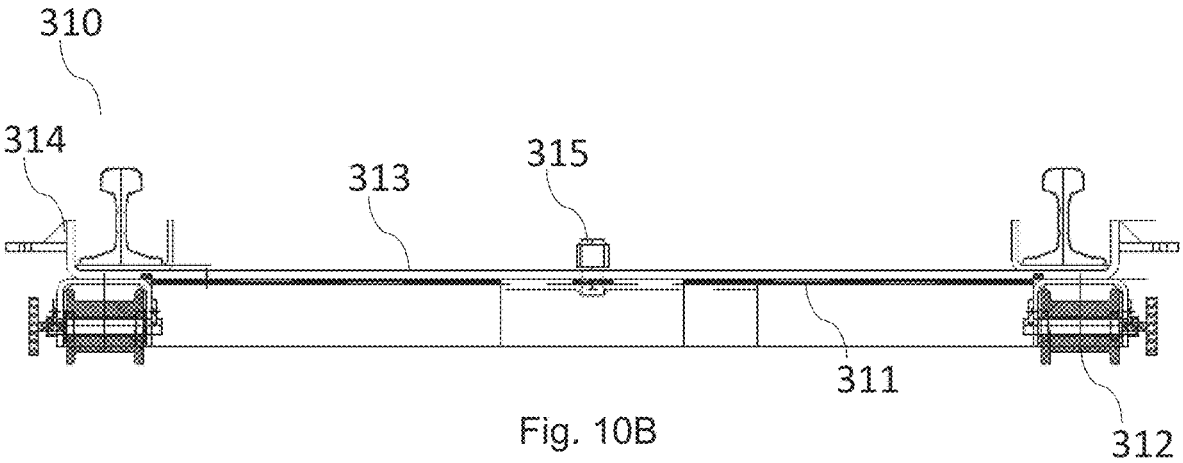
FIG. 10B shows a front view of the same transport element of the previous Figure arranged for a track width that is wider than the one above.
Figure 11A:
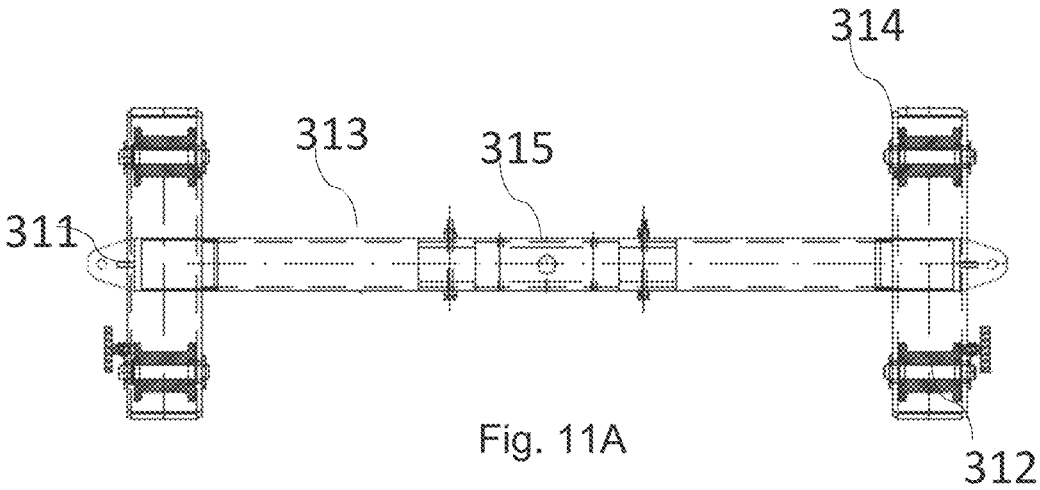
FIG. 11A shows the top view of the transport element of the railway track transport and transfer system, in which the pivoting beam remains perpendicular to the direction of the track.
Figure 11B:
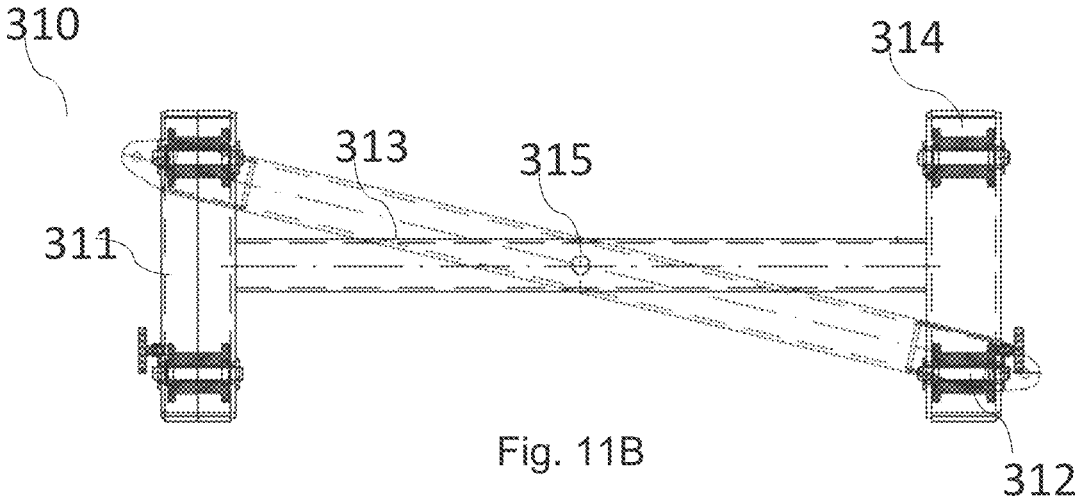
FIG. 11B shows the top view of the transport element of the railway track transport and transfer system, in which the pivoting beam is rotated to adapt to the curvature of the rail and the track when it is moving along the existing track.
Figure 12A:
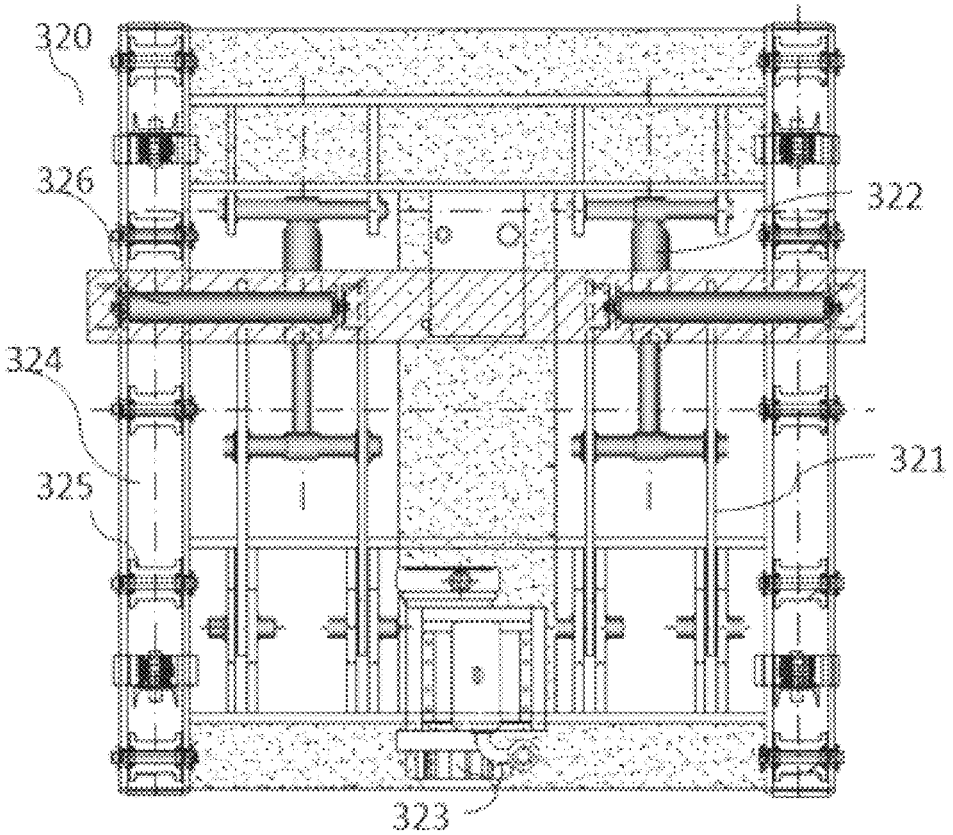
FIG. 12A shows a top view of the transfer element of the railway track transport and transfer system.
Figure 12B:
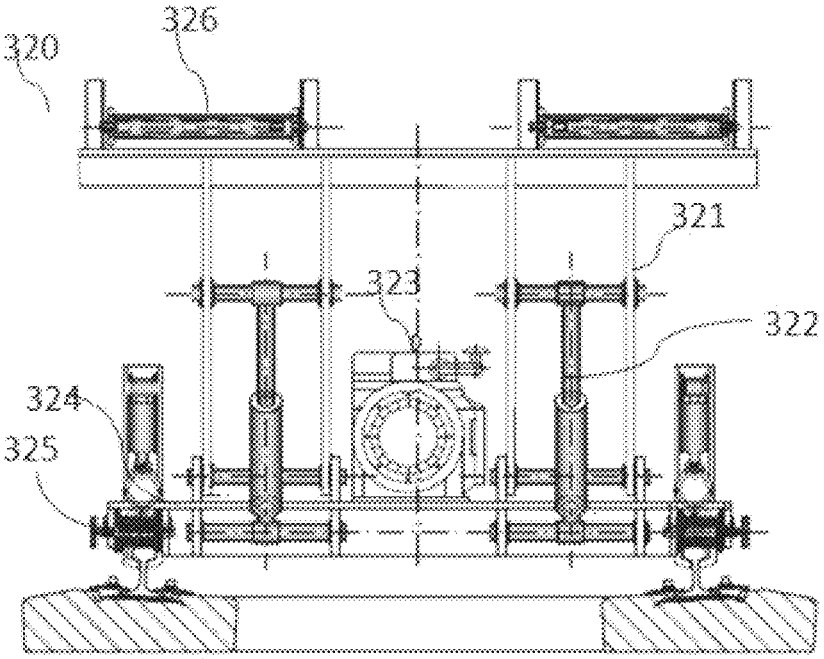
FIG. 12B shows a front view of the transfer element of the railway track transport and transfer system.
Figure 12C:
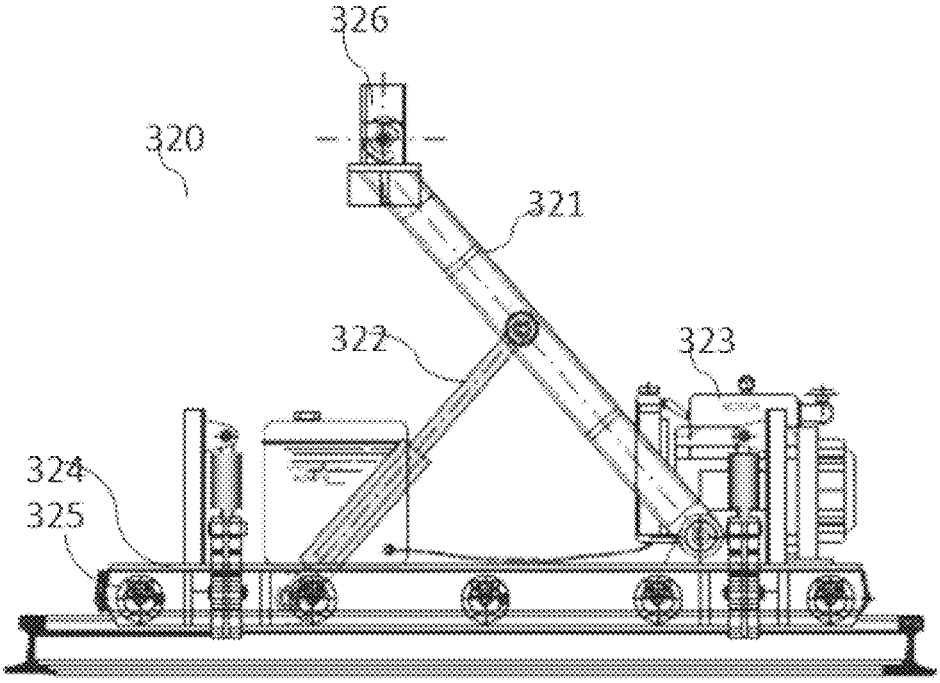
FIG. 12C shows a side view of the transfer element of the railway track transport and transfer system where the system of connecting rods and drive is observed in an elevated position with respect to the horizontal.
Figure 13:
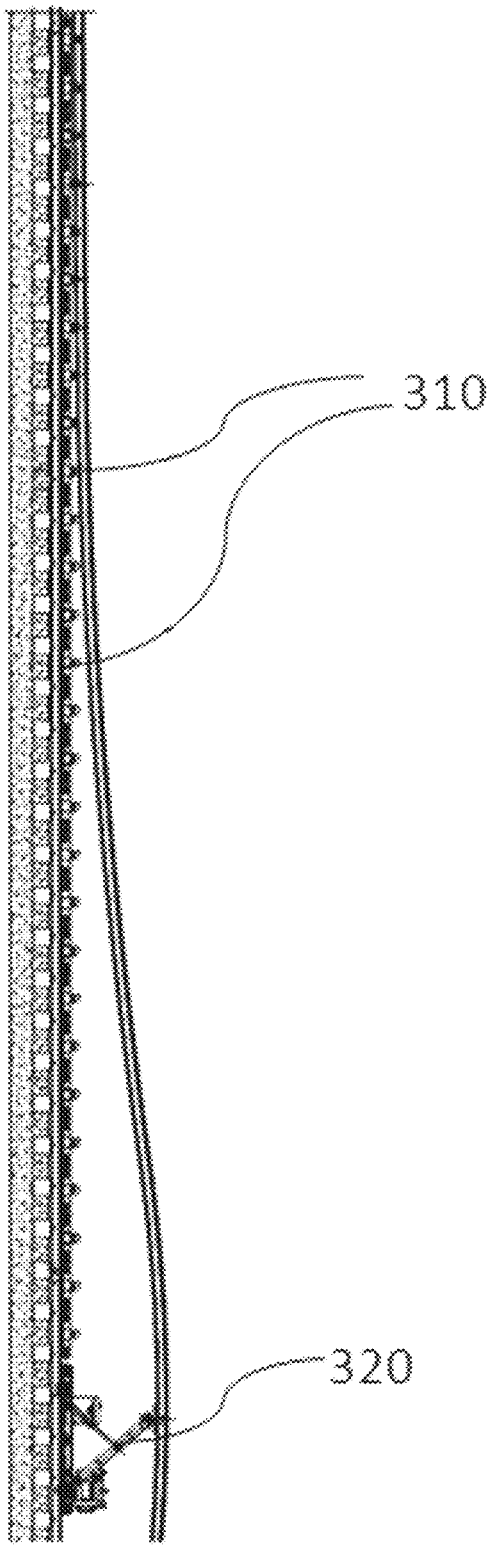
FIG. 13 shows a side view of a section of the deployment of the railway track transport and transfer system; specifically, the rail that is transported by the transport elements and is already elevated above the transfer element.
Figure 14:
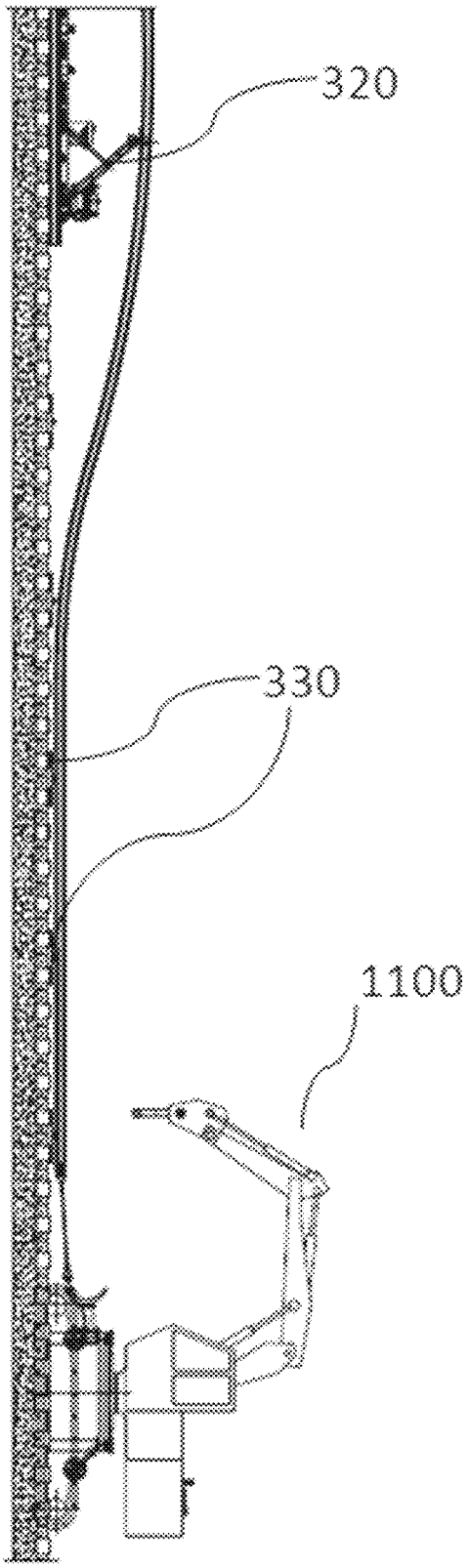
FIG. 14 shows a side view of another section of the deployment of the railway track transport and transfer system; specifically, the rail that is elevated above the transfer element and slid over the sliding elements by pulling with a traction element.
Figure 15:
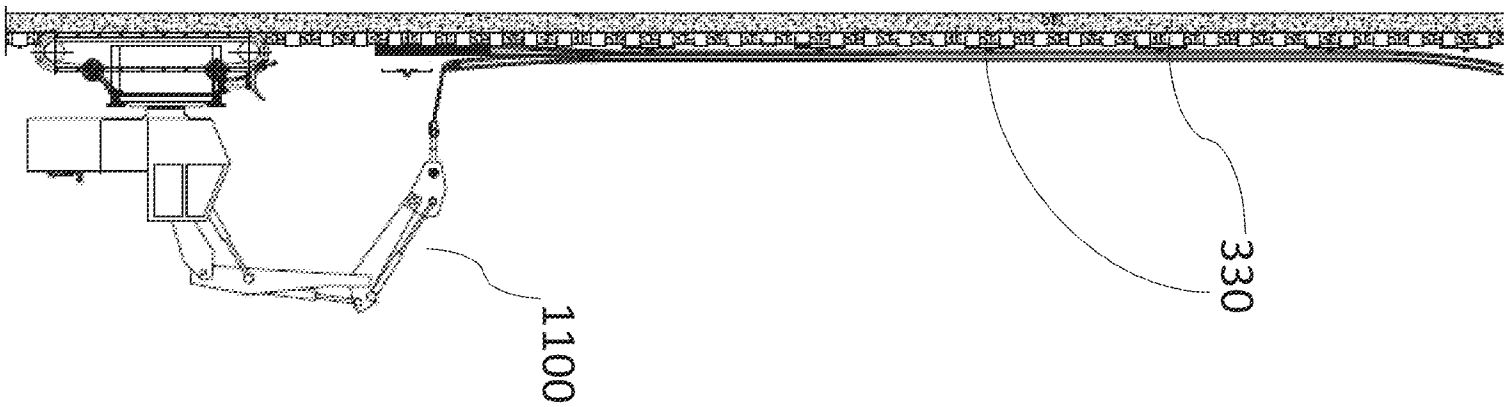
FIG. 15 shows a side view of another section of the deployment of the railway track transport and transfer system; specifically, the rail that is elevated above the transfer element and slid over the sliding elements by pulling with the traction element, but that, once the rail has reached its final position, it is observed how said traction element elevates the rail by the crane which is incorporated to remove the sliding elements and leave the rail resting on the sleepers.
Figure 15A:
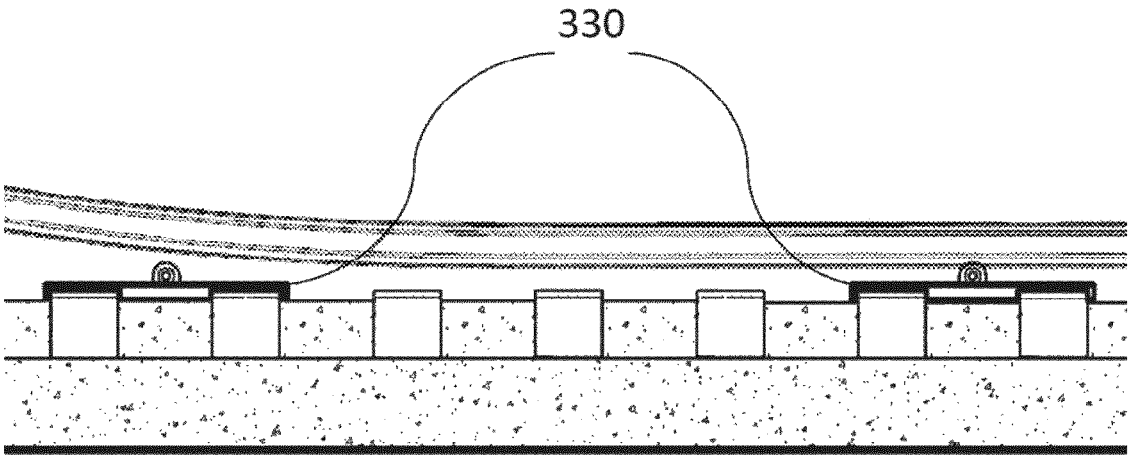
FIG. 15A shows an enlargement with the detail of the above figure of the sliding elements.
Figure 16A:
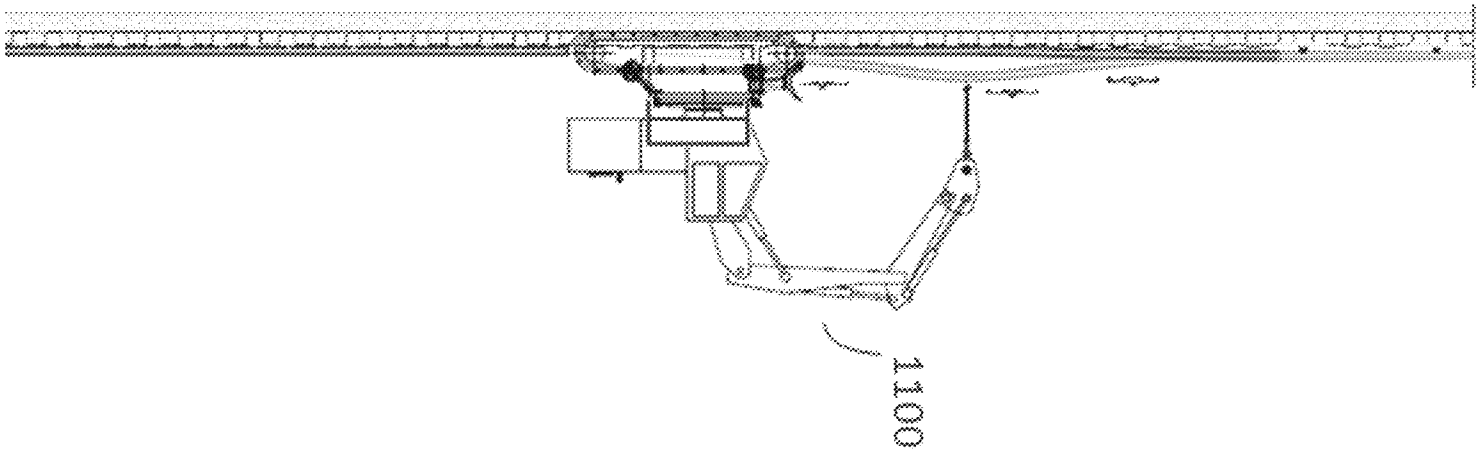
FIGS. 16A and 16B show elevation views of the transfer element in two different moments: when pulling the rail, FIG. 16B, and when lifting the assembled rail to recover the transport elements, FIG. 16B.
Figure 16B:
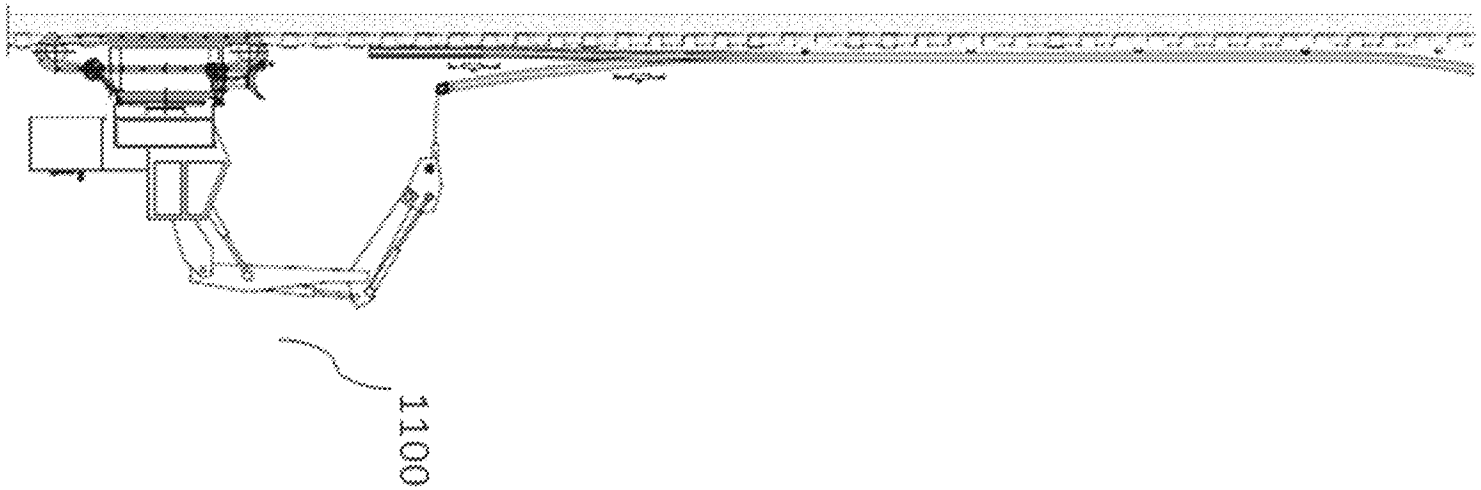
Figure 17:
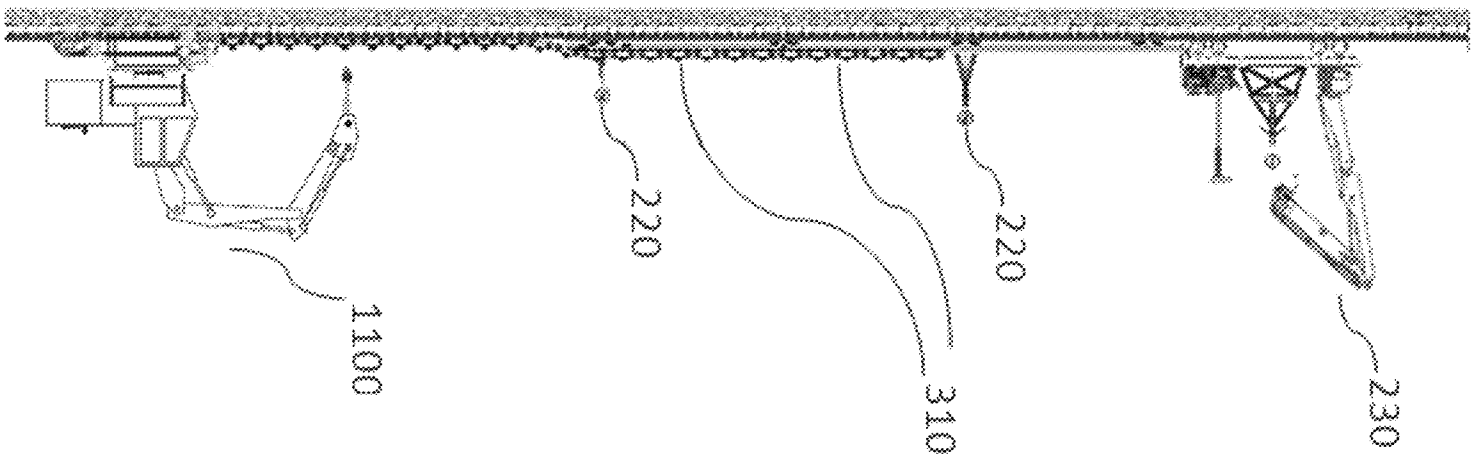
FIG. 17 shows the recovery of the translation elements once the operation of unloading and installing the rail is finished.

The elements defined in this detailed description are provided to aid in the general understanding of the invention. Consequently, one of ordinary skill in the art shall recognize that variations and modifications to the embodiments described in this document may be made without departing from the scope and spirit of the invention. In addition, the detailed description of the functions and elements sufficiently known is omitted for clarity and conciseness.

The method described below supports a railway track transport and transfer system, consisting of a puller machine for the unloading and placement of railway tracks, a wagon for unloading said railway tracks and elements for the transport and transfer of the rails to the point of installation.

The characteristics of each of these elements are as follows:

Puller Machine for Unloading and Placement of Railway Tracks

The puller machine (1100) makes it possible to unload and lay the railway tracks, which arrive on a rail-carrying train, quickly, safely and precisely.

The puller machine (1100) is comprised of several parts that differ based on the function to be performed:

Rail Traction Function.

For this function, the puller machine (1100) has a first part formed by a frame (110) widened to a distance that allows the circulation of the driving elements (120) bordering the sleepers placed along the track, and the driving elements (120) that will be used to move the puller machine (1100) when the needs of adhesion and fraction are high and it is necessary to drag a pair of rails in the configuration of continuous welded rail (CWR) with a length of up to 270 m.

The energy required for the movement of the puller machine (1100) is provided by a diesel engine (150) which drives hydraulic pumps that transform mechanical energy to hydraulic energy that is transmitted to the motors joined to the driving elements (120) that will transform the hydraulic energy received into mechanical energy by driving the rotation of said driving elements (120).

In a preferred embodiment, said driving elements (120) are of the caterpillar type, mainly for outdoor and irregular terrain, whereas in another embodiment, said driving elements (120) are made of rubber, mainly when the deployment of railway track is carried out in tunnels with a concrete base.

It also has a second part formed by a transverse beam (130) perpendicular to the direction of displacement of the puller machine (1100), located at the rear of the machine, which has been equipped with tying elements (140) the rail pull flanges, separated from each other at a distance equal to the width of the track to be mounted; this distance can be adapted to any track width.

The tying elements (140) for the rail, lugs, flanges and shackles are commercial and foreign to this invention.

This transverse beam (130) can be adjusted in height by means of hydraulic bottles attached to the frame (110) of the puller machine (1100), and serves to bridge the longitudinal levelling irregularities on the platform or ballast bed. Actuating them upwards in such a way that the end of the rails is higher than the sliding rollers, such that part of the weight of these rail ends will rest on the traction elements, thus improving their adherence if the traction effort to be carried out requires it.

Function of Recovery of Sliding Elements and Rail Positioning.

By means of an articulated arm (160) with a rail clamp (170) at the end, as a lifting crane, the device carries out the operation of lifting the rail for the recovery of the rail sliding elements placed on the sleepers, the rollers, and the placement of the rail on the sleeper, once the roller has been removed.

Function of Moving and Transporting the Sliding Elements

In order to speed up the movement of the machine and the transport of the sliding elements, the puller machine (1100) has been equipped with four railway wheels (180), with the possibility of adapting to the different track widths, which are hydraulically driven, allowing the puller machine (1100) to swiftly move along the already assembled track when the traction needs are not so demanding, i.e., throughout the whole process except when dragging the track pairs.

These four wheels (180) move vertically with respect to the frame (110) of the puller machine (1100), so that once resting on the upper surface of the rails, the caterpillars (120) or rubber wheels (120) used to split the rail remain in the air, and the movement of the puller machine (1100) is carried out by these railway wheels (180).

Wagon for Unloading Railway Tracks

It consists of a wagon (2100) or platform suitable for travelling on railway tracks, equipped with railway mounted axles (210), suitable for circulation on railway tracks of different widths, which is coupled to the rail-carrying train at the unloading end of the rails.

The purpose of this unloading wagon (2100) or platform is to avoid deflections of the railcar during the unloading, which can produce permanent deformations therein.

To this end, it has variable height (220) support elements installed on its upper surface, which serve as a guide to lead the rails from the platform of the rail-carrying train to the transport elements.

The wagon (2100), therefore, facilitates the unloading of the rails in pairs of predetermined length (e.g., 270 meters in length), through the support elements (220) that serve as a guide to lead the rails in a parallel way on the fastenings which receive them and direct them to the transport elements.

The width of these support elements (220) or windows, the space remaining for the passage of the rail, is gradually reduced, so that after the passage through the last of them, the position both in the vertical plane and in the horizontal plane of the rail head is adequate to come down on transport elements (310).

The support elements (220) can be regulated in height, which makes it easier to adapt the rail from its variable position on the rail-carrying train, and they have vertical and horizontal rolls (290) which facilitate the job of the puller machine (1100) for moving the rail forward minimizing the friction between the rail and the support element (220).

The wagon (2100) or unloading platform has a crane (230) to easily move the slings of twisted wire used to transmit the traction effort to the rail in the first phase of unloading. said crane (230) is ready to fold and deploy and, in its maximum deployment phase, it is ready to reach the support element (220) that is the furthest from this wagon (2100).

In addition, the unloading wagon (2100) can be used to transport materials by using the crane (230) of the slings as a tool for loading and unloading materials and to facilitate in the same way the unloading of small dimensions and other consumables.

The wagon (2100) also functions as a storage hangar for the transport element (310) of the rail. The transport elements (310) are set aside on a cased track (240) or additional track on the platform of the wagon itself (2100), which has a ramp (280) made up of two longitudinally collapsible rail coupons, cut in wedges to allow the transport element (310) to pass from the wagon to the assembly track, i.e., the wagon (2100) has said cased track (240) on its upper portion, in which said translation transport elements (310) are stored. In order to pass the transport element (310) from the platform of the wagon (2100) to the track in the assembly phase, it is provided with two rail coupons or pieces of short rail, which are collapsible and cut in bevel, such that, once collapsed, act as a ramp (280).

The wagon (2100) allows driving the rail from its location on the rail-carrying train to the transport elements and, in addition, doing it without allowing it to flex, which can cause the permanent deformations; this element serves as a guide for the rails.

Driving is achieved as the puller machine (1100) pulls the rail for unloading it from the rail-carrying train, through support elements (220) which are adjustable in height, through which the end of the rail is passed.

In order to position the rail head where it can be tied to the transverse beam of the puller machine (1100), it is necessary to use, as mentioned above, a flexible sling. Due to the traction efforts that the puller machine (1100) has to make to pull the rail, a sling of braided steel wire of great dimensions is necessary, which is difficult to manually handle; therefore, for handling this sling and the rail, the unloading wagon (2100) has been equipped with a hydraulic crane (230) to perform these tasks.

The energy necessary for moving the crane is given by a power-pack or connected power unit (260) and a generating set powered by a diesel engine.

This connected power unit (260) and generating set can also power a lighting tower (270) that allows these tasks to be carried out in low visibility conditions, whether they are carried out at night or inside tunnels.

Transport and Transfer Elements of the Railway Track

The translation of the track rails to their final position in the installation is carried out in several stages, for each of which different but related and coordinated means of transport are used.

In a first stage, the rails are carried from the rail-carrying train and the unloading wagon by transport elements (310)

moving on existing track. When this track ends and, therefore, the point is reached where there are sleepers on which to place the new rails, there are sliding elements (330) placed on the sleepers themselves on which the rails are to slide.

And in between, at the intermediate point, in this transit of the rails from the transport elements (310) to the sliding elements (330), there is a continuous transfer element (320) which allows the transfer of the continuous welded rail (CWR), which, supported on the transport elements (310), are moved along the already assembled track in a longitudinal direction, to slide on sliding elements (330) installed on the sleepers placed on the ballast bed. This transfer is performed in a continuous manner, with no need to lift the rail, using the pulling effort of the puller machine (1100).

This rail transport is from the rear or end point of the unloading wagon next to the parked rail-carrying train to the transfer element (320). To this end, the rail is loaded on said transport elements (310) and these are the ones that transport the rail on the assembled track, where the force necessary for movement is exerted by the puller machine (1100).

Once the tip of the rail exits from the wagons of the rail-carrying train, and with the help of the unloading wagon and its built-in guiding means, the rails are directed towards a pivoting beam (313) installed in the transport elements (310) at the end of which a there is a guide (314) on which the rails of the track are placed for transport.

When the rails are resting on the pivoting beam (313) and the weight of the rail section falls on the transport element (310), it begins to move longitudinally in the direction of the installation, dragged by the rail it supports, by the action of a pulling force of the puller machine (1100). As the rails moves forward, new transport elements (310) are incorporated to support the rail section removed from the rail-carrying train, thus gradually incorporating more transport elements (310) that support the weight of the removed sections of the continuous welded rail.

Depending on the type of rail and its length, the distance between transport elements (310) and, therefore, the number of transport elements (310) required to support the weight of the section supported may vary.

Each of the transport elements (310) of rail or tanks consists of a pivoting beam (313) designed to receive the pair of rails on its upper surface, where this beam (313) is prepared to accommodate and stabilize the rails supported during their transfer.

The beam (313) pivots on a vertical central axis (315) which is fixed to the frame (311) of the transport element (310), where this pivoting movement facilitates circulation, allowing it to adapt to different curvatures.

The frame (311) is rigid and is equipped with four railway wheels (312) which allow it to roll on the rail, while these wheels (312) have a "double tab". The contact of these tabs with the side faces of the rail head guides the transport elements (310) on the existing track when they are dragged by the supported rail that rests on them.

The constructive form chosen for these transport elements (310) makes them suitable for circulation on different track widths, and in particular on the three track widths used in Spain. Specifically, the frame (311), in its center zone, is disposed so as to increase or decrease in size.

When the transport elements (310) with the rail loaded on them reach the end of the assembled track and can no longer transport the CWR on the existing track, the system has sliding elements (330) with rollers previously placed on the sleepers without track at a mounting distance on the basalt bed. These elements with rollers (330) allow the rail to slide with little friction without the need to have a mobile element moving in the area of trackless sleepers.

The transfer of the rail from the transport elements (310) to these sliding elements is carried out by means of a continuous transfer element (320), which, taking advantage of the pulling force of the puller machine (1100), said horizontal pull is transformed by the transfer element (320) into a force with a vertical component which causes the rail to be raised in such a way that it no longer rests on the pivoting beam (313) of the transport element (310).

Thus, the transport element (310) is no longer being dragged and it stops. This mechanical system of continuous transfer (320) is equipped with rail guiding and sliding devices (326), which lead it to the sliding elements (330).

This device or continuous transfer element (320) is placed at the end of the assembled track, on a frame (324) including railroad wheels (325). It is equipped with a mechanical system of connecting rods and actuations. This system of connecting rods (321) and actuations (322), in its initial end position, is folded on the horizontal plane, and allows transit over the puller machine (1100) that is making the pulling effort during the transport of the rails on the transport elements (310).

Once the puller machine (1100) and the tip of the transported rails have passed said transfer element, by means of a mechanical actuation (322), it begins to unfold. The actuation (322) may be a hydraulic system supported by a diesel engine (323).

The connecting rod (321), which rotates on an axis fixed to the frame (324), starts to move, which causes the sliding element (330) on its end to contact the lower face of the conveyed rail or rail skid. As the connecting rod (321) continues to rotate, its end begins to exert a vertical component force that causes the rail to raise, separating it from the transport element (310), thus stopping said transport element (310) from being dragged along the rail and stopping against a stop installed at the edge of the transfer element (320).

When the actuation (322) and the connecting rod (321) reach their final position, the rail will be suspended between the end of the connecting rod (321) of the transfer device (320) and the support of the dragged transport element (310), where the rail describes, due to its own weight, a catenary curve.

The elevation of the connecting rod (321) is such that the vertical projection of this catenary on the rolling plane of the transport elements (310) has a length of at least the sum of the lengths of all the transport elements (310) that transport the CWR, so that they stop in the span of track assembled prior to the transfer element (320).

Once the rail has been raised and in a continuous manner, without having to stop the longitudinal movement of the rail, it is led to the sliding elements (330) that allow the CWR to move on the sleepers placed on the ballast bed.

With the sleepers in place, as mentioned above, the sliding elements (330) of rail are arranged on the sleepers with rollers. Each of these sliding elements (330) is extended to form a bridge between two consecutive sleepers, spaced by a previously defined spacing.

Each of these sliding elements (330) consists of a steel plate or metal profile of such length that it can be extended between sleepers and fixed to two consecutive sleepers as a bridge. This profile is fixed to a roller that is responsible for enabling the movement of a rail, supported on it, during its longitudinal movement in the direction of installation. The sliding elements (330) with these rollers are arranged on both sides of the sleeper, for each rail, successively keeping a certain equidistance.

Once the tail of the CWR has surpassed the transfer element (320) completely, it is necessary to remove the sliding elements (330), so that the underside of the rail rests on the sleepers placed on the ballast bed.

Since the puller machine (1100) is equipped with crane means, the rail lifting operation is carried out supported on them, for the recovery of the rollers or sliding elements.

By means of an articulated arm with a rail clamp at the end, as a lifting crane, the operation of lifting the rail is performed, which releases the weight of the rail and enables the recovery of the rail sliding elements (330) placed on the sleepers, and the placement of the rail on the sleeper, once the roller has been removed. The puller machine (1100) also has side trays which, like saddlebags on the machine chassis, allow the storage and transport of other components, such as, for example, the sliding elements (330) for the rails.

From these system elements, the method for transporting and transferring railway track comprises the following steps:

Rail Tie and Unloading to Transport Elements

With the help of the crane (230) of the unloading wagon (2100), steel slings are thrown through the support elements (220) of the unloading wagon (2100), which are used for pulling. A flanging operation of a pair of rails is then carried out on the last wagon of the rail-carrying train, with the means used to split and move the rails in the unloading direction with the help of the puller machine (1100). By means of the puller machine (1100), the rails are dragged through the support elements (220) until their heads pass through the last support element (220).

At this point, the slings of the rail are released and the traction element or puller machine (1100) approaches the head of the rail and the pulling flange is directly attached to the cross beam (130) of the element, traction device or puller machine (1100).

Load on Transport Elements and Rail Transport to Transfer Element.

After the pair of rails is tied directly to the puller machine (1100), traction is exerted on them by the puller machine (1100), until the complete exit of the rails is achieved, from the rail-carrying train wagons, an operation which, as mentioned above, is enabled by the guiding means (290) incorporated in the support elements (220) on the unloading wagon (2100), and the rails being directed and guided towards their support on the transport elements (310).

The puller machine (1100) begins to move longitudinally away from the unloading wagon (2100), dragging the rails; as the rail advances, the transport elements (310) are rolled one by one from the unloading wagon (2100) to the track assembled by the ramps (280) placed at the end of the wagon (2100), and they are inserted under the rails, supporting their weight and enabling, with their wheels (312), their transport.

The transport elements (310) are placed equidistant, at a distance such that the rail, depending on its own weight, does not flex excessively due to the action of gravity. In addition, spacers will be fitted between rails to strengthen the pair of rails and to prevent the rail from tipping over. The puller machine (1100) will continue to move away until the rails exit the unloading wagon (2100) completely and are only supported on transport elements (310).

The transport elements (310) then roll along the assembled track, pulled by the puller machine (1100) to the transfer element (320).

Transfer of the Rail from the Transfer Elements to the Sliding Elements.

Once the tip of the CWR surpasses the transfer device (320), placed at the end of the assembled track, the transport elements (310) can no longer transport the CWR on the existing track; then, the track will cease to be transported by the transport elements (310) and will be dragged using elements that make it easier to slide. These sliding elements (330) incorporate rollers and have previously been placed on the sleepers that have been previously placed and at a mounting distance on the ballast bed.

Continuous transfer from the rail transport system (310) to the rail sliding element (330) is carried out via transfer element (320), which, taking advantage of the pulling force of the puller machine (1100), is transformed by the transfer element (320) into a force with a vertical component which causes the rail to be raised in such a way that it no longer rests on the pivoting beam (313) of the transport element (310).

Thus, the transport element (310) is no longer being dragged and it stops. This mechanical system of continuous transfer is equipped with rail guiding and sliding devices, which lead it to the sliding elements.

Rail Sliding to its Final Position.

With the sleepers in place, the rail sliding elements (330) are arranged on top of them, with their rollers, each of them extended to form a bridge between two consecutive sleepers as mentioned above, and spaced by a previously defined spacing.

As the pair of rails is transferred from the transport elements (310) to the sliding rollers, the rails being directed and guided towards their support on the rollers or sliding elements (330) that were previously placed on the sleepers of the track.

With the sleepers in place, while the puller machine (1100) moves, some operators distribute the sliding elements (330) of the rail that are housed in the saddlebags of the puller machine (1100), and are transported by it, placing each one of them extended, forming a bridge between two consecutive sleepers as mentioned above, and separated by a previously defined spacing.17

When the entire rail has been transferred to the sliding elements (330), a cutting, squaring and flanging operation is carried out, i.e., an operation to join the ends of the rails immediately adjacent to each other.

Positioning of rail in its final location and recovery of sliding rollers.

At the end of the previous operation, the rail on each side is lifted to recover the rollers or sliding elements (330) that allowed the longitudinal movement of each rail.

This operation is carried out with the lifting equipment or crane (160) incorporated in the puller machine (1100), and it consists of lifting the rail, held at one end, the free end, to allow for the recovery of the aforementioned sliding elements (330), which are then loaded into the puller machine (1100) itself, as mentioned above, for transport to the new working position.

Once the previous stage has been completed, to the partial nailing of the track is performed, one sleeper every certain number of units, for example, one sleeper every 7 units.

Returning the Translation Elements to the Unloading Wagon.

Finally, the puller machine (1100) traces back its steps to the unloading wagon (2100) moving on the assembled track using the railway wheels (180) of variable track width available and finishes nailing, all components and devices being ready for the beginning of a new cycle.

When it reaches the transfer element (320), it must change its sliding mode to the caterpillars (120) or rubber wheels (120) and pass the transfer element (320) that is folded. Once passed, it rests on its railway wheels (180) and returns to the unloading wagon (2100), pushing the transport elements (310), which have previously been tied to each other, to prevent them from rolling out of control in the event of a favorable slope.

Once the transport elements (310) reach the unloading wagon, they begin to ascend to it platform by means of the ramps (280) prepared for this purpose. As the puller machine (1100) approaches the unloading wagon (2100), the transport elements (310) are coupled to the platform, until the puller machine (1100) is in position to begin the cycle and all transport elements (310) are on the platform of the unloading wagon (2100).

From here on, the cycle is repeated for other rails.

The invention claimed is:

1. A method for unloading, transporting and installing a railway track, comprising:

tying, by slings, two rails of railway tracks located in a rail-carrying train to a crane of an unloading wagon for unloading and laying the two rails of the railway tracks, pulling said rails with the crane of the unloading wagon, to move the two rails of the supporting elements of the unloading wagon until a most advanced end of the two rails reaches the supporting element of the unloading wagon furthest away from the rail-carrying train, changing the slings from the crane of the unloading wagon to a puller machine for unloading and placing the two rails of the railway tracks, pulling, by the puller machine, the two rails while the puller machine travels and moves away longitudinally from the unloading wagon, and as the rail advances, transport elements move from the unloading wagon on already assembled track so said transport elements are inserted under the two rails supporting their weight and enabling their transport, once the assembled track is finished, passing the two rails through a transfer element located at the end of the assembled track to sliding elements located along sleepers where the unloaded rails will be placed, recovering the sliding elements on which the two rails are supported via a crane of said the puller machine and leaving the two rails resting on the sleepers in a final position, and returning, the puller machine, to the unloading wagon, where, after passing the transfer element, the unloading wagon pushes the transport elements to the unloading wagon.

2. The method for unloading, transporting and installing a railway track according to claim 1, wherein:

the puller machine slides with rail wheels where there is assembled track, between the unloading wagon and the transfer element, while the puller machine uses drive elements, preferably caterpillar type or rubber wheels, when there is no track assembled to slide on.

3. The method for unloading, transporting and installing a railway track according to claim 1, wherein:

the transfer element remains folded when the puller machine passes over the transfer element.

4. The method for unloading, transporting and installing a railway track according to claim 1, wherein:

the transfer element transforms the horizontal pulling force exerted by the puller machine into a vertical component force which causes the two rails to be lifted as the two rails pass by and frees up the transport elements, in such a way that the transport elements stop moving forward.

5. The method for unloading, transporting and installing a railway track according to claim 1, wherein:

the puller machine comprises a transverse beam placed in its rear part and perpendicular to the direction of displacement of the puller machine and which is adjustable in height so the change of the rail ties of the step of changing the slings from the crane is carried out by attaching the slings directly to the transverse beam.

6. The method for unloading, transporting and installing a railway track according to claim 1, further comprising:

passing the transport elements from the unloading wagon to the already assembled track through a cased track or an additional track located over a top portion of the unloading wagon and a ramp located at the end of the unloading wagon.

7. The method for unloading, transporting and installing a railway track according to claim 1, wherein:

each of the transport elements is positioned at an approximately equidistant distance and sufficiently close to each other so that the rails do not flex excessively.

8. The method for unloading, transporting and installing a railway track according to claim 1, wherein:

each of the sliding elements is placed between pairs of consecutive sleepers.

* * * * *